United States Patent [19]

Kuparinen

[11] Patent Number: 4,605,193

[45] Date of Patent: Aug. 12, 1986

[54] FOLDABLE MUSIC STAND

[76] Inventor: Pertti K. Kuparinen, Haavikonkuja 3, SF-78210 Varkaus, Finland

[21] Appl. No.: 670,348

[22] Filed: Nov. 9, 1984

[51] Int. Cl.[4] ..... A47B 97/04

[52] U.S. Cl. ..... 248/460; 248/121; 248/166

[58] Field of Search ..... 248/544, 441.1, 447, 248/447.1, 460, 462, 463, 431, 443, 121, 528, 371, 398, 165, 166; 84/180, 181

[56] References Cited

U.S. PATENT DOCUMENTS

| | | | |
|---|---|---|---|
| 331,811 | 12/1885 | Newton | 248/462 |
| 411,482 | 9/1889 | Wootton | 248/166 |
| 439,186 | 10/1890 | Reams | 248/166 |
| 1,673,205 | 6/1928 | Romao | 248/166 |
| 1,734,577 | 11/1929 | Henry | 248/121 |
| 1,840,620 | 1/1932 | Dennis | 248/462 |
| 2,189,687 | 2/1940 | Thomas | 248/528 |
| 2,524,460 | 10/1950 | McDonald | 248/528 |

FOREIGN PATENT DOCUMENTS

| | | | |
|---|---|---|---|
| 50867 | 7/1889 | Fed. Rep. of Germany . | |
| 64799 | 12/1891 | Fed. Rep. of Germany . | |
| 20566 | of 1912 | United Kingdom | 248/460 |
| 675384 | 7/1952 | United Kingdom | 248/463 |

*Primary Examiner*—J. Franklin Foss
*Assistant Examiner*—Robert A. Olson
*Attorney, Agent, or Firm*—McGlew and Tuttle

[57] ABSTRACT

The purpose of this invention is a foldable music stand comprising a lectern or the like, which can be set in an inclined position, a vertical shaft and a folding leg support member. The lectern consists of a backplate and a shelf. The backplate is rotatably connected by a pivot means to the vertical shaft. The shelf of the lectern has a cross section in the shape of L and it is hinged to the lower edge of the backplate and attached by a lever into the vertical shaft. The lectern being in the inclined position or the operational position, a score is placed to rest against the backplate on the shelf. The leg support member is formed in a cross leg having a solid part and a moving part which can be moved in respect of this. The solid part is connected to the vertical shaft in the direction of the lectern. In the operational position the moving part is folded vertically in respect of the solid part. The shelf and the backplate of the lectern are foldable against each other into an upright position or a transport position, into which direction and same plane of the lectern the moving part of the cross leg is folding, the whole lectern thus being in its transport position and forming a platelike flat object.

7 Claims, 8 Drawing Figures

FOLDABLE MUSIC STAND

FIELD AND BACKGROUND OF THE INVENTION

The pesent invention relates to a foldable music stand comprising a lectern or the like, which consists of a backplate with a shelf which together can be set into an inclined position, a vertical shaft and a foldable leg support member.

The known music stands comprise a lectern or a blackplate or the like the inclination of which can be adjusted and a vertical shaft which has a lectern attached to its upper end the length of which is suitably adjustable. This kind of a music stand has been described in the German Patent Publication No. 64799. In music stands a foldable leg support member has also been used to which leg support member the vertical shaft has been connected. Foldable leg support members are generally been formed in a tripod or the like, which is foldable to lie parallel to the vertical support member. This kind of a solution has been described e.g. in the German Patent Publication No. 50867.

A slender structure can be considered as a disadvantage of the known music stands; they get easily broken during transfer or transport. Many music stands are foldable but even then they demand much space and they can not be piled one upon the other without the risk of getting broken.

SUMMARY OF THE INVENTION

The purpose of the present invention is to provide a new foldable music stand in which the above mentioned disadvantages are eliminated. A foldable music stand according to the invention comprises a lectern or the like, which includes a backplate and a shelf, a vertical shaft and a folding leg support member, against which backplate a score is placed to rest on the shelf, when the lectern has been brought into an inclined or operational position, and in which the shelf and the backplate of the lectern can be folded against each other into an upright or transport position, and which leg support member is formed in a cross leg having a fixed part and a moving part, which fixed part lies in a direction of the lectern, and into which same direction and same plane the moving part of the lectern can be folded, the whole music stand thus being in the transport position and forming a platelike flat object.

Further in a foldable music stand according to the invention the backplate is rotatably connected by a pivot means to the vertical shaft and the shelf of the lectern has a cross section in the shape of L, and it is hindged to the lower edge of the backplate and attached with at least one lever to the vertical shaft.

Advantages of the music stand according to the invention are a simple and firm structure and its foldability to a platelike flat object. The lectern is preferably adjustable only into two positions; an inclined operational position and a vertical transport position. The cross leg is solid in use and the moving part can be folded to lie parallel to the fixed part and the lectern respectively into the transport position. The music stand in its transport position is a flat platelike object. These can easily be piled one upon the other into a suitable transport or storage case which doesn't demand much space.

BRIEF DESCRIPTION OF THE DRAWINGS

In the following the invention will be described in detail with reference to the accompanying drawings in which.

DESCRIPTION OF THE PREFERRED EMBODIMENT

Figures 1, 2, 3, 4:
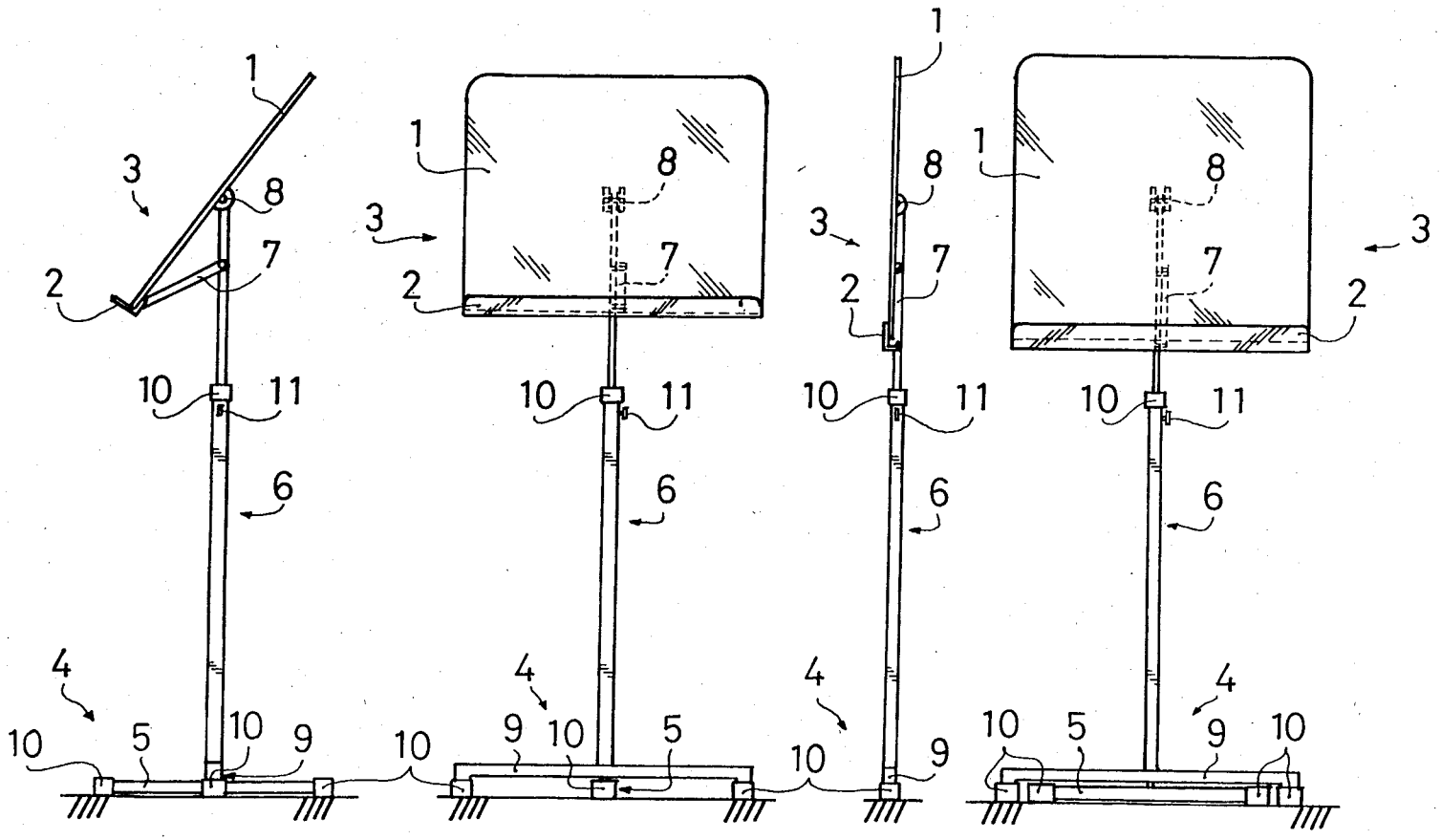
FIG. 1 shows a side view of a music stand according to the invention in the operational position.
FIG. 2 shows a front view of the music stand of FIG. 1 still in the operational position.
FIG. 3 shows a side view of the music stand according to the invention in the transport position.
FIG. 4 shows a front view of the music stand according to FIG. 1 in the transport position.

A music stand according to the invention comprises a lectern 3 or corresponding back member against which a music score can rest which back member consists of a vertical backplate 1 and a shelf 2, a vertical shaft 6 and a leg support member 4. The backplate 1 is rotatably connected to the vertical shaft e.g. by a tap or a hinge 8. The shelf 2 of the lectern has a cross section in the shape of L and it is connected by hinges to the lower edge of the backplate 1. In addition it is attached to the vertical shaft 6 by a lever 7. The vertical shaft 6 comprises two parts, a moving and a solid part which are securable to each other for example by a screw 11 for enabling the adjustment of the height of the music stand. The leg support member 4 is formed in a cross leg which has a fixed part 9 and a moving part 5 folding with respect to that. The fixed part 9 lies parallel to the backplate 1 and the shelf 2 of the lectern. The ends of the parts of the leg support member 4 and the top of the fixed part of vertical tube 6 are preferably provided with plugs 10 which are made of flexible material such as plastics or gum.

FIGS. 5–8 show in more detail the connection of lectern 3 and the vertical shaft 6 of a music stand according to the invention.

The top of the vertical shaft 6 is hinged by a pin 8 to the backplate 1 of the lectern 3. The pin 8 is fastened with bearings to a hole 12 which exists at the top of the vertical shaft 6. The ends of the pin 8 are arranged to clips 13 which are connected to the backplate 1 e.g. by rivets 14.

Two levers 71, 72 are arranged between the vertical shaft 6 and the lectern 3. The first ends of the levers 71, 72 are rotatably connected to the vertical shaft 6 by a pivot means 15 or respective, preferably to a place which locates somewhat further than half a way between the pin 8 and the fixing point of the vertical shaft 6 and the lower edge of the backplate 1. The other ends of the levers 71, 72 are rotatably connected to the lugs 23 of one leg of the self 2 for example by rivets 24.

Figures 5, 6, 7, 8:
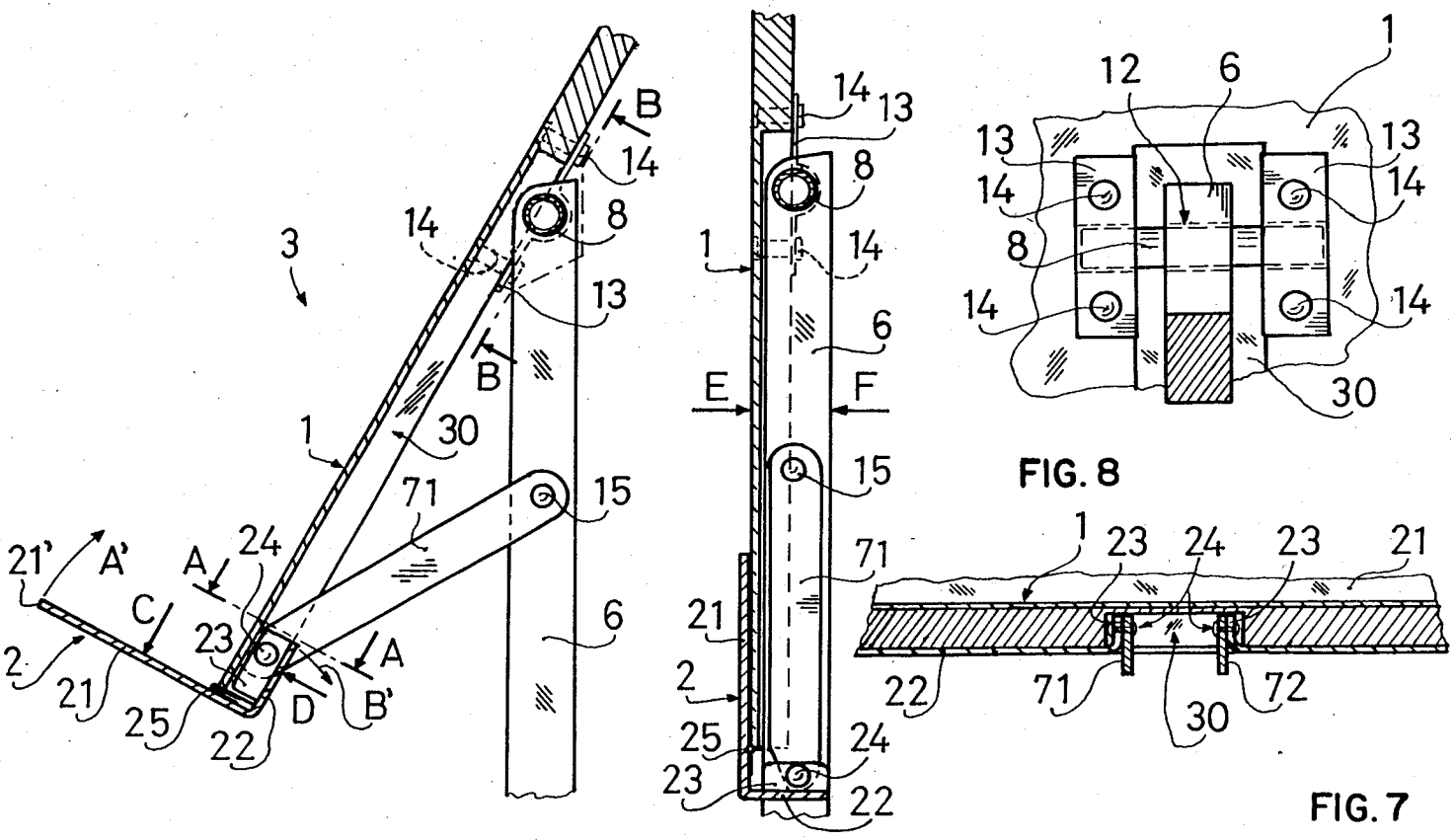
FIG. 5 shows a side view partly as a cross section view of a connection of the lectern and the vertical shaft in the operational position.
FIG. 6 shows a side view also partly as a cross section view of the connection according to FIG. 5 in the transport position.
FIG. 7 shows the cross section A—A of FIG. 5.
FIG. 8 shows the connection of the vertical shaft and the lectern seen from the back of the plate to the direction B—B of FIG. 5.

The shelf 2 in the shape of an L is connected e.g. by a piano hinge 25 near the bending point of the frontplate or first leg 21 and backplate or second leg 22 of the shelf to the vertical backplate 1. The distance to the bending point is for example as great as or greater than the thickness of the vertical backplate 1. The lugs 23 to which the levers 71, 72 are connected are horizontally located in the middle of the backplate 22. The lugs 23 are preferably formed from the backplate 22 by cutting from it and by folding so formed ends towards the vertical backplate as shown in FIG. 7.

The reverse face of the backplate 1 of lectern 3 can be provided with a guide track 30. This leaves a gap in backplate or second leg 22 for the entry of shaft 6 when the stand is folded. The top of the vertical shaft 6 and the lever 7 or the levers 71, 72 can be pressed into the guide track 30 when folding the music stand into the transport position.

A music stand according to the invention operates in the following way. Let us suppose, that the music stand is in its operational position (FIGS. 1, 2 and 5). Then a score is placed on the shelf 2 and it rests against the backplate 1. The music stand is brought into the transport position (FIGS. 3, 4 and 6) by pressing the outer edge 21' of the front plate of shelf 3 of the lectern in the direction A' towards the vertical shaft 6. The shelf 2 rotates around the hinge means 25 in a direction of the backplate 1. The fixing point (the rivets 24) of the other end of the levers 7; 71, 72 and the shelf 2 starts to turn downwards around hindge means 25 in the direction B'. In the course of the motion the levers 7; 71, 72 and the backplate 1 move more and more towards the upright position and the vertical shaft 6. Backplate 1 thus folds from the inclined position into the upright position to lie parallel to the vertical shaft 6. After this the moving part 5 of the leg support member 4 is folded to lie parallel to the solid part 9. When carried out in the same manner but in reverse order the music stand can be unfolded into the operational position.

It has to be noticed, that in the operational position downwards directed forces C such as the weight of the music score effective upon the shelf 2, its frontplate 21, will lock the music stand into the operational position: the other ends of the levers 7; 71, 72 are then pressed towards the reverse face of the backplate 1 in a direction D. Respectively, in the transport position forces E (FIG. 6) effecting of the backplate 1 or in respect to that reverse forces F press through the levers 7; 71, 72, the hindge 25 as a supporting line, the frontplate 21 against the vertical backplate 1. Thus the burden directed to the lectern 3 locks it in the transport position. As can be understood that the music stand can be easily and safely locked both into the operational and transport positions.

After the above mentioned simple actions the music stand will be in the transport position (FIGS. 3, 4 and 6) and it forms a platelike flat object. The thickness of the flat object is for example 25 mm. The thickest parts are the plugs 10 at the ends of the different parts 5, 9; 6. When music stands are parallelly piled one upon the other e.g. into a transport or storage case according to their measurements only the plugs of the stands come into contact with each other. Thus the metal or paint surfaces do not get scored or battered.

It will be understood, that the music stands according to the invention demand relatively little transport or storage space. For example the music stands of a big symphony orchestra, about 60 pieces demand a space the length×width×height of which is $110\times50\times(60\times2.5)$ $cm^3=0.823$ $m^3$. Thus there are no problems in transporting music stands according to the invention.

I claim:

1. A foldable stand comprising:

a vertical shaft;

a back member pivotally mounted to one end of said vertical shaft and having an operating position inclined with respect to an axis of said shaft and a transport position parallel to the axis of said shaft;

a shelf pivotally mounted to a lower end of said back member, said shelf having a first leg and a second leg extending at an angle to said first leg;

a fixed support part connected to said shaft at an opposite end thereof opposite from said back member and extending in a plane containing said back member with said back member in its transport position, a movable support part movably connected to said shaft at its opposite end and having a support position extending substantially perpendicularly to said fixed support part, and a transport position extending parallel to said fixed support part; and a lever having one end pivotally mounted to said second leg of said shelf and an opposite end pivotally mounted to said shaft, said lever being pivotally mounted to said second leg of said shelf at a location so that movement of said back member into its open position causes said lever to rotate said shelf into a use position with said first leg extending at an angle to said back member, and with said back member moved into its transport position, said lever pivoting said shelf into a transport position with said first leg extending parallel to said back member.

2. A stand according to claim 1, wherein said second leg of said shelf has a gap in which said shaft extends with said back plate in its transport position.

3. A stand according to claim 1, wherein the lower end of said back member in its transport position is at a predetermined location of said shaft, a point of pivotal connection between said lever and said shaft being slightly more than half way between a point of pivotal connection between said back member and said one end of said shaft, and said predetermined location on said shaft, said shelf having a bend point between its first and second legs, said lever being pivotally mounted to said second leg at a location spaced from said bend point and said back member being pivotally connected to said first leg of said shelf at a location spaced from said bend point.

4. A stand according to claim 3, wherein said back member includes a recessed guide track for receiving at least a portion of said shaft with said back member in its transport position.

5. A stand according to claim 4, including at least one additional lever pivotally mounted between said shaft and said shelf.

6. A foldable stand comprising:

a vertical shaft;

a back member pivotally mounted to one end of said vertical shaft and having an operating position inclined with respect to an axis of said shaft and a transport position parallel to the axis of said shaft;

a shelf pivotally mounted to a lower end of said back member, said shelf having a first leg and a second leg extending at an angle to said first leg;

a fixed support part connected to said shaft at an opposite end thereof opposite from said back member and extending in a plane containing said back member with said back member in its transport position, a movable support part movably connected to said shaft at its opposite end and having a support position extending substantially perpendicularly to said fixed support part, and a transport position extending parallel to said fixed support part;

said first leg of said shelf having a gap therein in which said shaft extends with said back member in its transport position; and at least one lever pivotally mounted between said shaft and said second leg of said shelf for pivoting said shelf into a storage position with its first leg parallel to said back member when said back member is in its transport position, and for pivoting said shelf into an open position with said first leg extending at an angle to said back member when said back member is in its open position.

7. A stand according to claim 6, wherein said back member comprises a back plate having a recess for receiving at least a portion of said shaft with said back plate at its transport position.

* * * * *